US005160286A

United States Patent [19]

Hill

[11] Patent Number: 5,160,286

[45] Date of Patent: Nov. 3, 1992

[54] PERSONNEL TRANSFER SYSTEM

[76] Inventor: George Hill, 1856 Wells Rd., #188, Orange Park, Fla. 32073

[21] Appl. No.: 661,933

[22] Filed: Feb. 28, 1991

[30] Foreign Application Priority Data

Jul. 4, 1990 [CA] Canada ..... 2020443

[51] Int. Cl.[5] ..... B63C 9/00

[52] U.S. Cl. ..... 441/80; 182/142

[58] Field of Search ..... 114/264, 365; 441/80, 441/83, 35, 38; 182/142; 414/139.5

[56] References Cited

U.S. PATENT DOCUMENTS

| | | | |
|---|---|---|---|
| 610,617 | 12/1960 | Rollings | 244/115 |
| 2,471,544 | 3/1945 | Ring | 244/115 |
| 2,557,079 | 6/1951 | Cutri | 441/80 |
| 2,817,860 | 1/1957 | Fritz | 441/83 |
| 3,392,940 | 7/1968 | Valkenburg | 244/115 |
| 3,648,858 | 3/1972 | Barron et al. | 414/139.5 |
| 3,702,690 | 11/1972 | Higgins | 114/365 |
| 3,801,050 | 4/1974 | Stone | 244/115 |
| 3,912,192 | 10/1975 | Shirley | 242/107.4 |
| 4,111,281 | 9/1978 | Jacobs | 182/142 |
| 4,294,331 | 10/1981 | Reynoir | 114/264 |
| 4,365,579 | 12/1982 | Perez | 114/349 |
| 4,522,144 | 6/1985 | Klem | 114/378 |
| 4,527,503 | 7/1985 | Connelly | 441/87 |
| 4,610,635 | 9/1986 | Austevoll | 441/80 |
| 4,627,821 | 12/1986 | Bradley et al. | 441/83 |
| 4,646,929 | 3/1987 | Plissonneau et al. | 441/80 |
| 4,652,246 | 3/1987 | Thorgeirsson | 441/80 |
| 4,678,446 | 7/1987 | Dahan | 441/80 |
| 4,773,887 | 9/1988 | Steffanus | 441/80 |
| 4,781,144 | 11/1988 | O'Brien | 114/365 |
| 4,822,311 | 4/1989 | Doerffer et al. | 441/87 |
| 4,883,301 | 11/1989 | Pugh | 441/83 |

FOREIGN PATENT DOCUMENTS

| | | |
|---|---|---|
| 0535577 | 1/1957 | Canada . |
| 1224676 | 7/1987 | Canada . |

*Primary Examiner*—Jesûs D. Sotelo

*Attorney, Agent, or Firm*—Dennis H. Lambert

[57] ABSTRACT

A personnel transfer apparatus is provided herein. It includes a rigid but open personnel transfer chamber provided with a buoyant support for persons in water and is suitable for personnel transfer or for personnel evacuation and rescue. The apparatus includes a deck, a buoyant, shock-absorbing base supporting the deck, and a plurality of padded peripheral posts upstanding from the deck. These posts are used for lifting purposes. One of the posts is a central floatation, padded post. Such post is not to be used for lifting purposes. The posts provide a cage for surrounding personnel on the deck. The deck and the shock-absorbing base have sufficient buoyancy to support the whole chamber and deck in the water with the deck disposed slightly below the water level. A roof is supported by the posts and supporting wire ropes are associated with the roof at the region of each of the peripheral posts for suspending the device with several persons thereon by wire ropes which are connected to the second vessel from which personnel are to be transferred. The base of the personnel transfer chamber is connected to a tag line, which, in turn, is connected to a tugger line to be wound on a winch mounted on the deck of the second vessel.

30 Claims, 7 Drawing Sheets

PERSONNEL TRANSFER SYSTEM

BACKGROUND OF THE INVENTION (i) Field of the Invention

This invention relates to a personnel transfer system. More particularly it relates to a personnel transfer device and a personnel transfer apparatus for the purpose of transferring personnel from a first vessel to a second vessel, or for rescuing personnel from a first vessel to a rescue vessel, at sea.

(ii) Description of the Prior Art

The most common personnel transfer apparatus for rescuing personnel at sea are lifeboats. However, in the case of severe storms which cause high waves, the use of lifeboats is rendered impractical, should the need arise. Lifeboats may be damaged by being thrown against the hull of the ship during launching, or may be swamped by the waves. Also, high waves and violent seas may preclude entering a lifeboat from the deck of the vessel. After launching, should it be successfully accomplished, wave action may swamp the lifeboat, or injure its occupants by throwing them about inside the lifeboat.

Enough experience has now been accumulated to demonstrate the limitation of escape equipment provided for personnel working on offshore platforms. Much of the past and present safety provisions have been biased toward providing escape craft supported at the sea surface, such as boats. This "floating lifecraft" fixation has been discredited as providing inadequate protection for personnel abandoning doomed offshore platforms.

Superficially, it appears that sturdily constructed and well-provisioned surface lifecraft, entered efficiently and launched successfully, is an effective means of preserving life. However, the violent storms destroying these platforms have claimed the lives of enough personnel to thoroughly discredit these surface crafts as havens of refuge for personnel. Of course, if the personnel can be removed from the platform, well in advance of developing life-threatening weather conditions, the problem would be solved. Boats and aircraft, employed in time, are quite effective in preserving life. It is the illusion that platforms are effectively designed to withstand the fury of cyclonic storms that has lead to the entrapment of personnel by their decision to ride out the danger of the storms. In the face of platform collapse, it is now evident that few lifecraft at the surface of the sea have been preserving a significant percentage of the lives of the personnel. Obviously, something is dreadfully wrong with the superficial assumptions that have been made to date by personnel seeking safety at the sea surface.

With safety proven non-existent at the surface of the sea, it has been suggested that refuge be sought entirely below the surface. Serious consideration has been given to the concept of transporting personnel to a location entirely below the surface. It has appeared that a system can be provided to transport threatened personnel a significant distance below the surface of the disturbed sea to provide dramatic increase for their chances of survival. Seemingly, all that was required was a change in conventional attitude to accept a submersible vessel for transporting personnel to a safe sea depth. It now appears economically chimerical to provide a life-support system for a completely submersible escape vessel.

A logical combination of the concepts embodied in a completely submersible lifecraft is possible. If a lifecraft form can be provided which places the majority of its bulk a significant distance below disturbed surface conditions while providing safe access to life support surface systems, the disadvantages of both prior systems can be eliminated.

Accordingly, means have been sought to support the use of lifeboats. In U.S. Pat. No. 4,365,579, patented Dec. 28, 1982, by Perez Jr., for example, a life survival capsule was provided of substantially spheroidal shape. The capsule had self-contained life supporting facilities and supplies for approximately 16 occupants. It was made of double-hulled construction and included a thermal insulating material between the hulls. Restraint devices were provided to prevent injury to occupants. Multiple entrances or exits, were also provided including an entrance from the interior of the ship on which it was mounted. Automatic and manual release devices were provided to free it from the ship to which it was attached. This patent suffered from the inherent deficiency that it was, in effect, merely directed to a lifeboat.

U.S. Pat. No. 4,522,144 patented Jun. 11, 1985 by Klem, provided a rescue system for a marine structure such as an offshore drilling rig or production platform which included an enclosed type lifeboat constructed to be supported onboard the marine structure by being releasably-suspended over free water from a single point or fulcrum. The fulcrum was located relative to the center of gravity of the lifeboat such that the lifeboat, in its suspended position, adopted a predetermined slanting orientation which it maintained substantially constant throughout its free fall when released from its suspension. This patent suffered from the inherent defiency that is was, in effect, merely directed to a lifeboat.

U.S. Pat. No. 4,627,821 patented Dec. 9, 1986 by Bradley et al, provided a rescue device for use with a helicopter which included a floatation ring large enough to surround several standing persons and a rigid, non-buoyant open decking capable of supporting those persons. A collapsible netting surrounded the deck and connected the floatation ring thereto. The floatation ring had sufficient buoyancy to support the whole device when in the water with the deck suspended below the water level and with several persons standing on the deck and which were partially-submerged. Supporting cables for use with a helicopter hoist were fixed both to the ring and to the deck so that when the device was lifted, the ring was held a predetermined distance above the deck. This patent suffered from the deficiency that its structure was not sufficiently rigid to protect persons being transported.

U.S. Pat. No. 4,773,887 patented Sep. 27, 1988 by E. T. Stepfanus, provided a rescue device for small boats. That rescue device included a rescue basket of open lattice work having a bottom wall with a high side wall inboard and a raised edge outboard. Rollers mounted to the side wall engage guide rails extending downward along the hull of the boat. A winch and cable system raised the basket from a submerged position in which the person being rescued could be easily maneuvered into the basket utilizing the buoyancy of the water, and a raised position in which upward travel of the rollers was limited by detents in the guide rails. Continued operation of the winch caused the basket to pivot around the rollers bringing side wall into a horizontal position generally level with the top edge of the boat.

The person being rescued was rolled onto the side wall where aid could be administered during transport to the land or the victim can be easily brought completely into the boat. In this pivoted position, the bottom wall of the basket was substantially vertical so that the person being rescued could not roll overboard. A latch mechanism locked the rollers in the detents and the bottom wall of the basket may be cinched against braces by the winch to form a stable platform for transport of the person being rescued to land. This patent suffered the disadvantage of a complicated structure including movable portions which were not fail safe.

U.S. Pat. No. 4,781,144 patented Nov. 1, 1988 by O. P. O'Brien, provided an offshore evacuation system for drilling rigs or platforms. It included a launch structure for a survival craft. That structure included at least one support strut adapted to be pivotally attached at one end thereof to the platform superstructure and which carried at the other end thereof at least one support cradle for the survival craft. The cradle was rotatable between an upper position and a lower position. Means were provided for effecting rotation of the launch structure from said upper to the lower positions. A closed companionway lead from the platform accommodation unit to the loading position of the survival craft was in sealing relationship with the survival craft. This patent suffered the disadvantage of a complicated structure including movable portions which were not fail safe.

U.S. Pat. No. 4,822,311 patented Apr. 18, 1989 by J. W. Doerffer et al, provided a free fall, submersible life saving device for an offshore structure having a spherical pressure shell in a casing. The upper part of the device had a lifting frame and at least one manhole closed with a cover. The lower part had ballast, an anchor, and a windlass for the anchor rope having automatic control of the tension in the anchor rope. The device was launched by a catapult on the offshore structure for horizontal movement in free fall to the water surface, where it submerged and was anchored until resurfacing, by release of the anchor, for rescue. This patent suffered the disadvantage of a complicated structure including movable portions which were not fail safe.

Harness devices and nets are presently available for use with helicopters for lifting survivors from open water and winching them into a helicopter. Harness devices are only capable of lifting one person at a time and require the person to be conscious and able to put on the harness. Net devices have also been used for pulling survivors from water and have usually been of the so-called side-entry type. However, the existing side-entry net devices are extremely difficult to enter. The net folds in the water, and the survivor has to find the opening and disentangle it before entering. A problem also exists in the excessive swinging of the harness-net device in high wind conditions.

Most of the existing baskets are made from wires soldered together to give a mesh structure equipped with two gripping handles joined by their central section by means of a non-detectable connecting component provided with a hoisting eye. These non-flexible, non-collapsible baskets often cause excessive obstruction, which restricts their handling and storage. In addition, being metallic, they need constant maintenance to limit the intense corrosion to which they are subjected. They are furthermore very heavy and can undergo permanent deformation under the action of load and shock. They are usually made in one piece, and their repair requires renewal operation which cannot easily be carried out. A problem also exists in the excessive swinging of the harness-net device in high wind conditions.

A rolling net, e.g., a kind of an elastic lattice is also presently available, where one side of the net is fixed within the gunwale of a ship and the other is pulled up with a person in the net rolling up the side of the ship. The device is unfit for use in heavy sea. The device is not capable of being transported to the person, it is fixed to the gunwale and only made for life boats patrolling to a wounded person in calm sea. It is not intended for other uses, for example, for use on usual ships.

Another secure rescue basket is provided by Canadian Patent Number 1,224,676, patented Jul. 28, 1987. Prior rescue baskets usually comprised various forms, a circular basket structure having a grid or net bottom and a peripheral wall provided with buoyancy means, cushion padding etc., the basket being connectable to a lowering or retrieval wire, the other end of which being connected to a davit or crane structure onboard a vessel, a main platform—floating or the gravity type, a helicopter or the like. An inherent disadvantage of such structure was that the wire becomes slack due to the swell of the sea, whereby the wire, the connector—e.g., a hook, a swivel and the like, represents a potential danger for the person or persons in the rescue basket. The patented rescue basket was handled by means of a weighed wire. The guide for the wire on the rescue basket was provided in the form of a centrally extending tubular guide means, the guide means extending to a such height above the basket bottom that a slackening of the wire only will result in the wire bending outwardly and eventually hit the outside of the basket wall, without hitting personnel sitting in the basket. A problem also exists in the excessive swinging of the harness-net device in high wind conditions.

Another problem with the prior rescue baskets resides in cushioning the basket upon it being hauled-down onto the deck of a vessel. Many devices have been provided to give a shock-absorbing effect.

For example, Canadian Patent Number 535,577 patented Jan. 8, 1957 by A. S. Fletcher et al, provided a pneumatic shock-absorbing device comprising an inflatable, perforated bag and a membrane covering a perforation in the bag and of lower breaking strain than the bag, whereby the bag will absorb a relatively violent initial impact without bursting, but will still retain sufficient air to afford continued cushioning after the initial impact.

U.S. Pat. No. 4,883,301 patented Nov. 28, 1989 by B. G. Pugh, provided an improvement in a personnel/-cargo net having at least one spreader ring. That spreader ring was provided by a base spreader ring including top and bottom rings secured together in vertically-spaced relationship. A buoyant pad surrounded each of the top and bottom rings. At least one separate, fluid-containing, shock absorbing means was provided for absorbing landing- or collision-shock experienced by the base spreader ring. Such shock-absorbing means was located above the buoyant pad. This patent suffered from the deficiency that its structure was not sufficiently rigid to protect persons being transported.

A rescuing basket was also provided by U.S. Pat. No. 2,557,079, but it had many drawbacks. The person being rescued must climb into the basket over a stiff floating girdle and upon a shallow net with small meshes, where he will not be meshed and is therefore vulnerable in a storm and heavy seas. The basket was difficult to manage up the side of the ship and the friction seeks to overturn it, especially in heavy sea. Therefore the basket had to be suspended free and therefore needed a boom. Such a boom was a part of the device and the person can not be saved except when the person fell into the sea below the boom. If the boom was on the one side of the ship and the person fell into the sea on the other, the device was of no use.

A net device was proposed in U.S. Pat. No. 2,817,860 which issued to Fritz, on Dec. 31, 1957. This patent disclosed a net device having an open top with a floatation ring so that the main part of the net was suspended under water. This device is intended to rescue only one person at a time since during rescue the net was partially-collapsed and the netting bottom provided a kind of sling for the survivor. A problem also exists in the excessive swigning of the harness-net device in high wind conditions.

U.S. Pat. No. 4,678,446 patented Jul. 7, 1987 by Daham, provided a device for rescuing personnel from water comprising a crane positioned on a boat or other rescue structure and which included a horizontally- and vertically-movable crane boom. An elongated member was vertically-movable with respect to the crane boom, and a float was positioned beneath the elongated member for floating on the water. A net extended below the float, and means were provided for supporting the net from the elongated member. When personnel were in the water, the crane was operated to move the boom from an inboard position to an outboard position, and the elongated member was permitted to move downwardly with respect to the boom such that the buoyant means floated on the water. At this position, the net extended beneath the float in the water. The net was moved forwardly by operation of the boom (and/or the boat) such that the person was within the net. The operator then manipulated the boom to hoist the person on the rescue structure. This structure was said to be provided for scooping personnel out of the water without such personnel needing to assist in their own rescue. A problem also exists in the excessive swinging of the harness-net device in high wind conditions.

U.S. Pat. No. 4,610,635 patented Sep. 9, 1986 by Austevol, provided an arrangement for picking up personnel. It included a basket or container which was connected to a ship and which was adapted to be conveyed between a work position partially-submerged in the sea and a rest position onboard the ship. The basket was rigidly-connected to a boom which was rotatable about its axis so that the basket in the work position was movable in a vertical plane substantially parallel to the vertical side of the ship, and which was pivotable between the work position, in which it projected outwards substantially-horizontally from the side of the vessel and the rest position. This patent suffered from the deficiency that its structure was not sufficiently rigid to protect persons being transported. A problem also exists in the excessive swinging of the harness-net device in high wind conditions.

U.S. Pat. No. 4,294,331 patented Oct. 13, 1981 by R. H. Reynoir et al, provided an improvement in a system for escaping from an offshore drilling or production platform in an emergency situation which included a stable floating structure forming a safe haven anchored near but at a safe distance from the platform. In the old system an aerial cableway extended between the platform and the haven, and a personnel carrier was movable along the cableway. The haven was a semi-submersible structure for increased stability. The system included a buoyant floating haven anchored in a relatively fixed position near, but at a safe distance from, the platform, a downwardly inclined cableway extending above water from the platform to the haven and a personnel carrier suspended on the cableway for transporting personnel from the platform to the haven. In such system the haven was in the form of a self-propelled vessel, namely, a catamaran. Such a vessel, however, not only was expensive but was also subject to some degree of pitching and rolling in rough seas. Further the cableway was in the form of two parallel cables which had to be properly tensioned by appropriate means carried on the haven. While a two-cable cableway provided increased stability for personnel carrier, it was more expensive than a single cable and, further, it was difficult to maintain the same tension in both cables of a two-cable cableway. Without the same tension, one cable will sag below the other with consequent undesirable leaning of the carrier. Additionally, the provision of means on the haven for tensioning the cableway is unnecessary in most installations because suitable tensioning means usually are readily available on the platform. In the patented system, however, a floating haven was fixedly anchored near, but at a safe distance from, the production platform. At least one cableway unsupported between its ends was attached to and extended above the water between the platform and the haven, with the cableway inclining downwardly from the platform to the haven. A personnel carrier was suspended from and was movable along the cableway for transferring personnel from the platform to the haven. The haven included at least one upright buoyant cylinder and means for ballasting and deballasting the cylinder. Means also defined an enlarged watertight compartment mounted to the upper end of the cylinder with the top of the compartment forming a weather deck. The cylinder and the compartment-defining means together formed a structure ballastable to float with the compartment partly submerged for increased stability. A problem also exists in the excessive swinging of the harness-net device in high wind conditions.

U.S. Pat. No. 4,527,503 patented Jul. 9, 1985 by R. F. Connelly provided a span buoy escape system for offshore platforms. The safety system included an offshore platform supporting personnel above the surface while it extends below the surface of the sea. A floatable escape vessel in the form of a spar buoy was mounted on the platform approximately at sea level. When dismounted from the platform, the escape vessel was ballast controllable such that a substantial amount of the entire vessel was below sea level to provide stability as a floating vessel. The top of the upper portion was openable and included means by which the personnel may enter the top portion from the platform and travel to the lower portion. The escape vessel was mounted on the platform at a location from which it could be dismounted into the sea after receiving the personnel. A compartment was provided in the lower portion of the spar buoy and a winch was mounted in the compartment. An anchor was located on the seabed. A tether connected the anchor and the winch and operated within the spar buoy to control the length of the tether between the anchor and the winch to permit the spar buoy to float at the surface of the sea above the anchor.

A problem also exists in the excessive swinging of the harness-net device in high wind conditions.

U.S. Pat. No. 4,646,929 patented Mar. 3, 1982 by B. P. Plissoneau et al, provided a basket for life-saving use at sea, which could be used from a boat or a helicopter. The patented life-saving basket included a plurality of parallel horizontal frame elements connected to at least two U-shaped hoops arranged in planes perpendicular to the planes of the frame elements to form mesh sides of the basket. The bottom of the basket was provided with longitudinal elements forming supports. Each hoop was connected to each frame at each point of intersection by a separate connecting element. The free ends of each hoop and those of two handle elements of inverted U-form were joined by a top edge frame which included two longitudinal members on which are engaged, spaced by distance pieces. The free ends of the hoops and the handle elements, and two transverse members connected to the ends of the longitudinal members. This patent suffered from the deficiency that its structure was not sufficiently rigid to protect persons being transported. A problem also exists in the excessive swinging of the harness-net device in high wind conditions.

U.S. Pat. No. 4,652,246 patented Mar. 24, 1987 provided a life net to rescue men from sea or water on board a ship or upon a pier. The patented rescue net structure for rescuing persons from the sea or other bodies of water had a net with mesh openings which were larger than thigh size but which were smaller than chest size. The net was attached to side ropes which were provided with floats. The side ropes at a forward end of the structure were extended to form pulling ropes. A sinker rope extended between the side ropes at the rear end of the structure. The sinker rope had the effect of submerging the rear end of the structure in the water, and pulling together rear end portions of the side ropes while their front ends remain open. Thus a partial enclosure was formed into which a person to be rescued can enter and be enmeshed in the net in an upright position. This patent suffered from the deficiency that its structure was not sufficiently rigid to protect persons being transported. A problem also exists in the excessive swinging of the harness-net device in high wind conditons.

A problem also inherent on those systems which employed a helicopter, e.g., U.S. Pat. No. 4,627,821, was that the cable means for suspending the device from a helicopter, had to be arranged to allow easy entry of the device over a flotation ring. The cable means were fixed to the deck and fixed or limited in movement relative to the ring so that when the device was lifted by the cable means the major lifting forces were transmitted to the deck while the ring was held a predetermined distance above the deck.

U.S. Pat. No. 2,471,544 patented May 31, 1949 by G. A. Ring, provided means for connecting mooring cables to rotary winged aircraft. In operating a helicopter from the deck of a ship, it was found that the pitching and rolling movements of the ship relative to the helicopter may be such as to cause landing to become difficult or dangerous. If such relative motion was great at the moment landing is effected, the forces resulting therefrom may produce destructive stresses in the helicopter. The patented device included means for connecting a mooring or landing cable to rotary winged aircraft. A guide cable was secured to the aircraft at two points spaced laterally from a vertical line passing through the center of gravity thereof. A pair of pulleys was also secured to the aircraft for guiding the guide cable, the pulleys being spaced from the points and lying on the opposite side of the vertical line. The guide cable was longer than a line passing from one of the points through the pulleys and back to the other of the points. A landing cable carriage was mounted upon the guide cable at a pair of points lying between the pulleys and the points. This system suffered the deficiency that it was only operative against the lift of a helicopter and could not be used for hauling down a personnel transfer chamber.

Landing a helicopter on a small deck, particularly on a ship, can be a very difficult and tricky operation. To minimize accidents, this was usually accomplished with the aid of a securing system in which a haul-down cable was attached to the helicopter, usually after being obtained from the deck by a messenger cable lowered by the helicopter. A deck-mounted winch is then used to haul-down the helicopter to the deck level and to secure it.

One difficulty with systems of this type was that, while they adequately and safely pulled the helicopter down to the deck, they did not provide sufficient lateral support for the helicopter while it was on the deck and during the last few feet of descent impart severe side loads to the helicopter. Some auxiliary arrangement must therefore be used to laterally-secure the helicopter on the deck, or the risk of damage through lateral movement must be borne.

One technique for hauling down and securing such helicopter is shown in U.S. Pat. No. 3,392,940, Jul. 16, 1968, by J. F. Van Valkenburg. The patent provided an apparatus for automatically anchoring or securing a drone or other type of helicopter to the surface on which it lands. The improved anchoring apparatus included a drum assembly, a first cable system that extended from a first fixed point on the drum assembly along one edge of the landing surface back to a second fixed point on the drum assembly, a second cable system that extended from a third fixed point on the drum assembly along the opposite edge of the landing surface back to a fourth fixed point on the drum assembly, means for controlling rotation of the drum assembly, and means for maintaining portions of the cables along opposite sides of the landing surface in parallel until a predetermined amount of tension is applied to the cables. This system suffered the deficiency that it was only operative against the lift of a helicopter and could not be used for hauling down a personnel transfer chamber.

In U.S. Pat. No. 3,801,050, patented Apr. 2, 1974, by W. N. Stone, a system was provided for hauling-down and securing a helicopter or the like with a haul-down cable loop which attached at one point to the helicopter and at another point to a deck winch. The cable loop passed through the deck at two separate locations via swivel sheaves so that while the helicopter was being hauled-down, the cable acted like a single cable, exerting a downward force and, after the helicopter was on the deck, exerted both vertical and lateral forces to secure the helicopter on the deck. The cable looped over a draw sheave below deck, which was connected to the winch by a draw line so that the haul-down cable was free to run over the draw sheave to equalize tension during haul-down. After landing, the sheaves and cables would be locked by suitable braking means so that the two cables from the helicopter to the deck-mounted sheaves could restrain the helicopter.

Canadian Patent Number 610,617 patented Dec. 13, 1960 by W. T. Rollings, provided a two-stage air-cushion device for absorbing the shock of a load falling to the ground, comprising an upper air cushion, a lower air cushion, and a platform interposed between the cushions for supporting the load, the lower cushion being collapsible upon striking the ground. Means was provided for inflating the upper cushion by air forced from the lower cushion by its collapse on the ground, the upper cushion then pressing upwards against the load and cushioning the latter in relation to the platform. This system suffered the deficiency that it was only operative against the lift of a helicopter and could not be used for hauling down a personnel transfer chamber.

U.S. Pat. No. 3,912,192 patented Oct. 14, 1975 by A. J. W. Shirley, provided a restraining device for holding objects in position on the deck of a moving craft, particularly for holding aircraft in position on the deck of a ship. The device was of the type comprising a spring-loaded drum capable of turning in a mounting and carrying a strop or similar flexible member for connection to the object to be held, the unwinding of which was resisted by the spring. The improvement of the invention consisted of a ratchet control mechanism including a ratchet wheel truning with the drum and acted on by a pawl controlled by a hydraulically-damped pendulum so as to be moved into engagement with the ratchet teeth when the pendulum was swinging through more than a predetermined angle from the vertical. As long as the deck was substantially horizontal, the aircraft or object would be held in position by means of strops from at least three of the restraining devices, but it would nevertheless be possible to move the aircraft as required by extending one or more of the strops against the effect of its spring and allowing the remaining strop or strops to be taken up under spring control. On the other hand, as soon as the deck of the craft tilted beyond the predetermined angle to the horizontal, the pendulum would move the pawls into engagement with the ratchet teeth, preventing the drum from rotation and thus holding the aircraft firmly in position. A manually-controlled pawl could also be provided so as to lock the drum against rotation even when the deck was horizontal.

Launching systems for life support capsules are required to be both rugged and yet simple and reliable in operation. It is important that they be capable of lowering a life support capsule into the sea off of a derrick or offshore oil rig without the necessity of human attention on the rig. Since the capsules have a considerable weight, it is important that the descent of the capsule to the surface of the water be controlled. Since such system should be designed for use primarily in emergency conditions, it was important that it function smoothly and properly with a minimum of attention. Capsule launch systems have been provided which utilized a combination of hydraulic cylinders and movable sheaves. While such systems were generally satisfactory, they were characterized by high cost. Hydraulic cylinder rods were subject to corrosion and high maintenance and repair costs. Also changes in temperature had a greater affect on lowering rate due to changes in hydraulic fluid viscosity. Further, since the hydraulic fluid used to operate the system usually was inflammable, and the hoses and other connections were subject to damage, the hydraulic system could be rendered useless in the event of a fire or extreme heat. Winches with centrifugal brake energy absorbers have been used in launch systems but experienced problems with heat dissipation and wear at brake surfaces when subjected to relatively high loadings and large descent heights.

U.S. Pat. No. 3,702,690 patented Nov. 14, 1972 by W. T. Higgins, provided a launching system which was said to be useful for raising and lowering life support capsules and the like from offshore drilling rigs, in which the capsule was lowered by a winch at a controlled rate as regulated by a centrifugal blower operated through speed-up gearing. In the patented system, a disk brake on the blower shaft holds the life support capsule in any given position. Provision was included for releasing the brake at a remote point, such as within the capsule, to provide for an unpowered and controlled descent. The brake was connected through a one-way clutch so that the capsule may be raised by the rotation of the winch while the brake is on to prevent accidental descent of the capsule. An electric motor was provided for raising the capsule by the winch, and is isolated by means of a clutch which works on an operator common with that of the brake to assure that the motor is declutched prior to releasing the brake, in a lowering operation. Provision was included for raising the capsule by hand, and also for manually retrieving and paying out the cable when the capsule was not attached.

SUMMARY OF THE INVENTION

(i) Aims of this Invention

The principal object of the present invention is therefore to provide a device which can transfer personnel from one vessel to another vessel, e.g., can rescue several persons at one time. The device should be easy to enter and once a person has entered it, he should be relatively safe even if the device was not immediately transferred from one vessel, e.g., a drill rig, to another vessel, e.g., a rescue ship.

(ii) Statement of Invention

By this invention, a personnel transfer apparatus is provided for providing buoyant support for persons in water and which is suitable for the transfer of persons from a first vessel to a second vessel floating on water. The apparatus comprises a rigid, substantially-flat deck and a buoyant, shock-absorbing base supporting the deck, the deck and the shock-absorbing base having sufficient buoyancy to support the whole apparatus and the deck in the water with the deck suspended slightly below the water level; a plurality of peripheral posts, and a central post upstanding from the deck, the posts being provided with protective padding along their length, the posts being spaced apart to provide a cage for surrounding personnel on the deck, with the central post not to be used for lifting purposes; a roof supported by the peripheral posts; supporting cables associated with the roof at the region only of the peripheral posts for suspending the device with several persons thereon by those cables; and a tag line secured to the personnel transfer apparatus for connection to the second vessel.

This invention also provides a personnel transfer system for transferring personnel from a first vessel to a second vessel comprising: a) a swingable boom system including a swingable boom system associated with the first vessel; b) means at the end of the swingable boom system for temporarily but firmly securing the boom to a personnel transfer apparatus; c) a tagline and tugline guidance means connected between the personnel transfer apparatus and a landing area on the second vessel; d) a tugger line having a loop end, connected to the tagline; and e) a constant tension winch associated with the second vessel and connected to the loop end of the tugger line for winding in and paying out the tugger line.

(iii) Other Features of the Invention

By one feature of the invention, the peripheral posts and the central post are each hollow but are filled with a buoyant flotation material.

The personnel transfer apparatus preferably includes a plurality of supports connected to an associated peripheral post, the plurality of supports providing a combined frusto-conical shape, the support thereby providing the roof therof, e.g., where each support includes a lower eared end for connection to an associated cable.

The buoyant base is preferably formed of a suitable foam material, e.g., ethafoam covered with vinyl. The protective padding preferably comprises a suitable buoyant foam material, e.g., ethafoam covered with vinyl.

The personnel transfer apparatus is preferably also provided with personnel restraining means, e.g., seat belts, or a peripheral mesh.

The central post is preferably provided with a surrounding seating bench, e.g., where the bench is provided with a lower storage area. The central post is also preferably provided with a cylindrical surrounding vertically arranged hand rail, e.g., where the base of the central post is provided with a storage area. The seat, e.g., bench, is preferably provided with seat belts and the base of the bench is preferably provided with a shock absorbing system.

The peripheral posts are preferably provided with vertical hand rails, and also with a mesh material encircling the perimeter of the peripheral posts.

The roof is preferably provided with hand rails and/or is provided with a mesh ceiling.

The personnel transfer apparatus is preferably provided with a depending ear for securement to the tagline.

The landing area preferably comprises a plurality of individual pads of shock-absorbing material surrounding a tether area, each adjacent individual pad being secured to one another by rope means, e.g., where the tether area contains a tether comprising: f) a base plate secured to the deck of the vessel; g) a semi-circular ring secured to the base plate; and h) a ring captured by the semi-circular ring.

The tagline preferably includes a lower timbered eye, an upper timbered eye and a first shackle secured to an upper timbered eye of the tagline, the shackle also being secured to the depending ear on the base of the personnel transfer apparatus. A snatch hook is provided which is connected to the lower timbered eye of the tagline, and a second shackle connecting the tagline to the loop end of a tugger line and may preferably also include a load cell interposed between the first shackle connected to the tagline, and the second shackle connected to the loop end of said tugger line, and, if so, also includes a safety bridle spanning the load cell.

The personnel transfer system preferably includes a lifting sling assembly comprising a plurality of lifting sling lines having loop ends, the loop ends being secured to a ring which is secured to a lower loop end of the tugger line, each lifting sling line being adapted to be secured to a depending ear of the personnel transfer apparatus.

The personnel transfer system preferably includes the personnel transfer apparatus as described above for the first embodiment of this invention.

In preferred embodiments of the invention, the tag line is hauled down using an existing cargo-handling 10-ton capacity tugger winch which is equipped with constant-tension mode capability. The capacity of the tugger winch in the constant-tension mode can be adjusted from the range of 0 to 1.5 tons.

BRIEF DESCRIPTION OF THE DRAWINGS

In the accompanying drawings.

Figure 1:
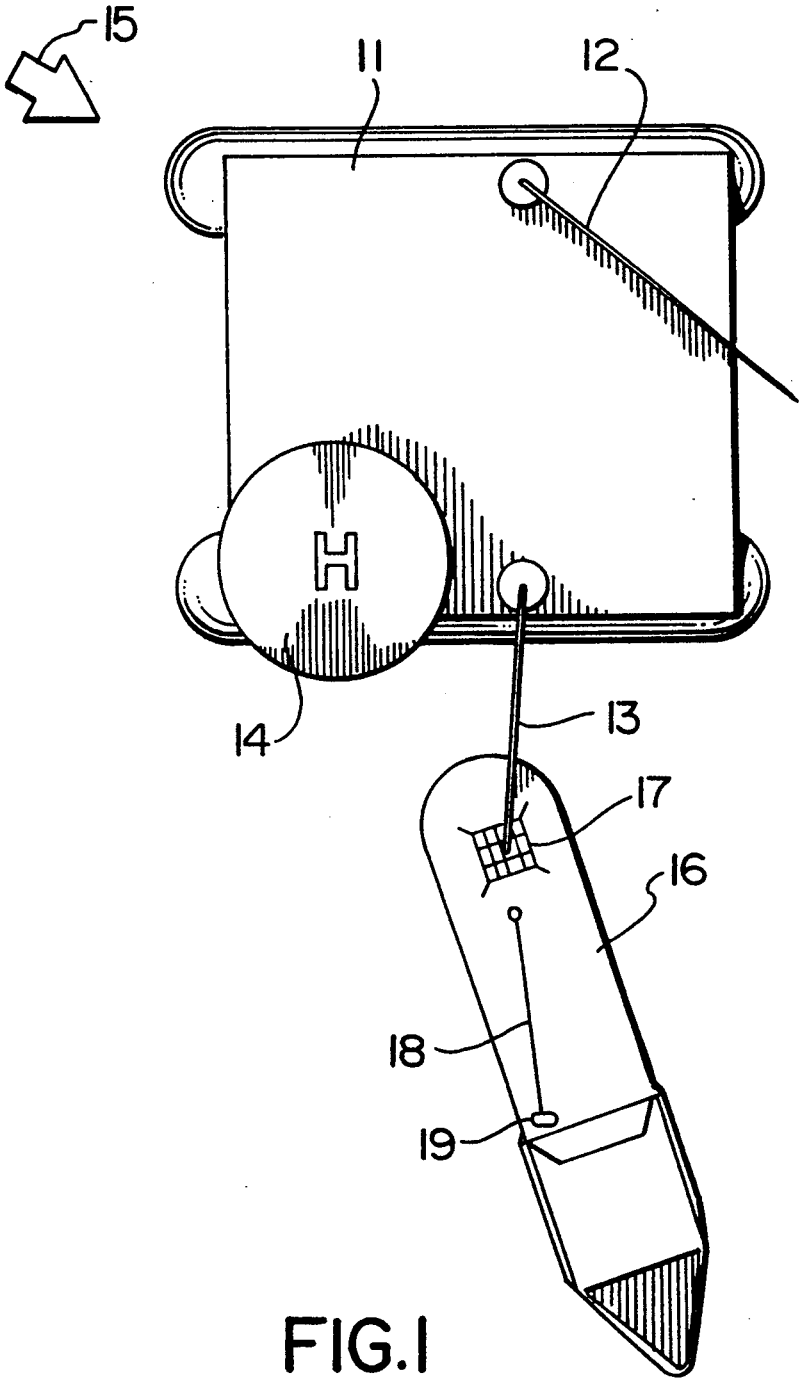
FIG. 1 is a schematic plan view of a typical rescue operation.

DETAILED DESCRIPTION OF THE PREFERRED EMBODIMENTS (i) Description of FIG. 1

As seen in FIG. 1, the generalized view shows a drill rig 11 where rescue of personnel is to take place, the drill rig 11 including a starboard crane 12, a port crane 13 and a helideck 14. While not shown, the invention is also operative for transfer of personnel from one vessel to another even under non-emergency conditions. The prevailing wave direction is also shown by arrow 15.

The rescue vessel 16 is directed downwind and the landing pad 17 thereon is associated with the port crane 13. A tugger cable 18 for connection to the personnel transfer apparatus is wound on a winch 19.

Figure 2:
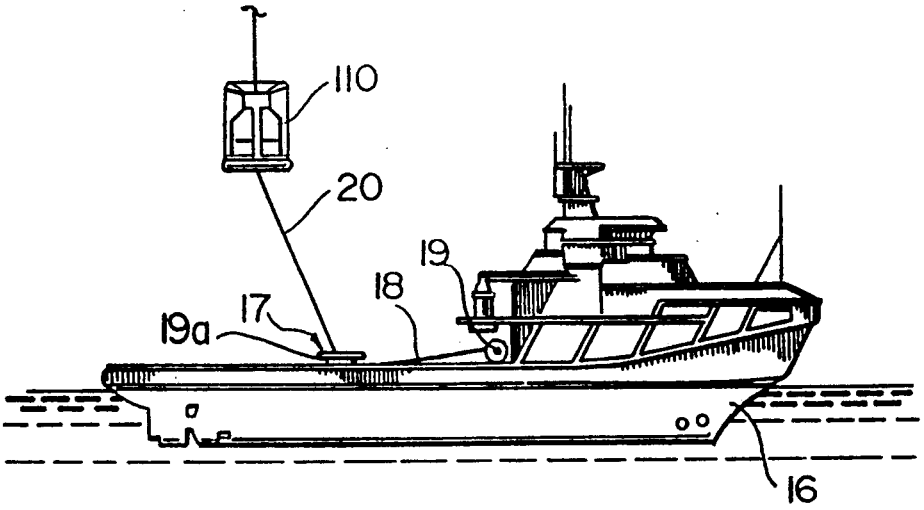
FIG. 2 is a side-elevational view showing a typical transfer of rescued personnel.
Figure 3:
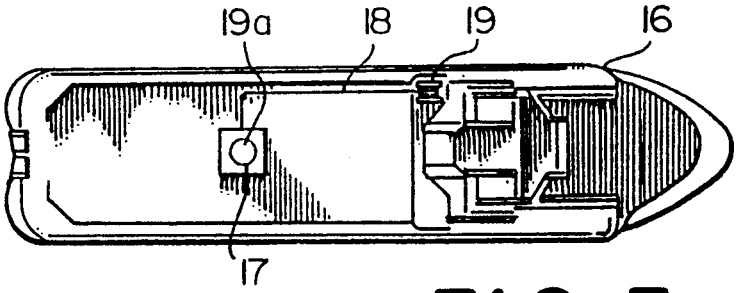
FIG. 3 is a top plan view of the view shown in FIG. 2.

(ii) Description of FIGS. 2 and 3

FIGS. 2 and 3 show the rescue vessel with the personnel transfer apparatus transfer basket 110 being hauled down by the tagline 20 and the winch 19, which winds or pays out the tugger cable 18. Winch 19 is a constant tension tugger winch. The personnel transfer apparatus 110 is hauled down controllably by means of the tagline guidance system 19 to the landing pad 17.

Figure 4:
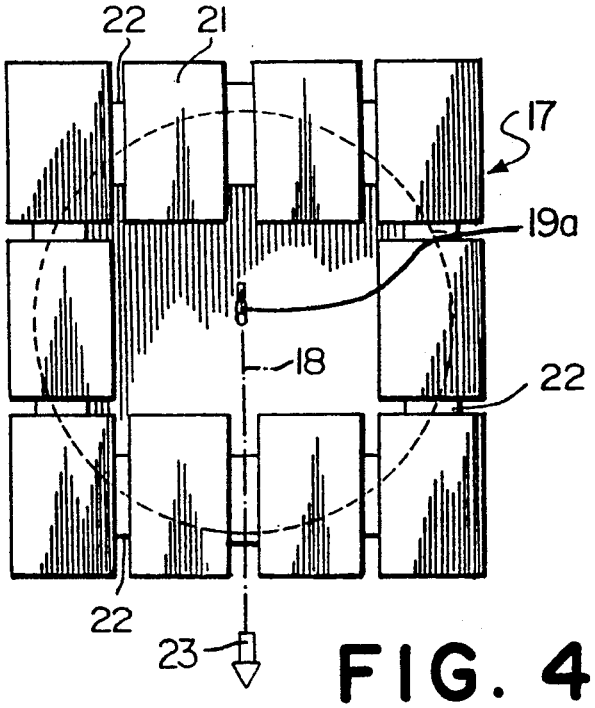
FIG. 4 is a top plan view of a typical landing site for rescued personnel.
Figure 5:
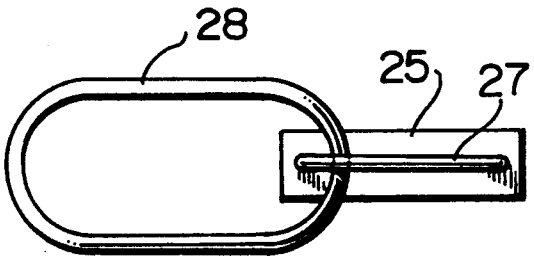
FIG. 5 is a top plan view of a typical tether mechanism in its "at-rest" position.
Figure 6:
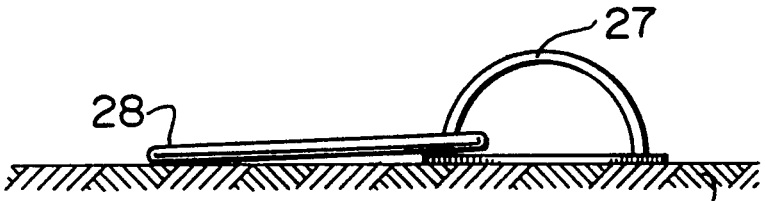
FIG. 6 is a side-elevational view of the tether mechanism of FIG. 5 in its "at-rest" position.

(iii) Description of FIG. 4

FIG. 4 shows the personnel transfer apparatus landing site 17 which is in the form of a rectangle provided by ten rectangular pads 21, e.g., 3'×2'×3" thick, of a suitable cushioning material, e.g., ethofoam or polystyrene foam disposed around a rectangle including the tagline guidance system 19*a*. The rectangular pads 21 are bound to one another by ropes, e.g., ¼" nylon rope 22. The tagline 20 from the tagline guidance system 19*a* is led to the tugger cable 18 and thence to the winch 19 as shown by arrow 23.

(iv) Description of FIGS. 5–8

FIGS. 5, 6, 7 and 8 show portions of the tagline guidance system 19*a*. A rectangular base plate 25 is secured to the main deck 26 of the rescue vessel 16. The base plate 25 is provided with a semi-circular steel eye 27 rigidly secured thereto. The steel eye 27 captures an oval steel ring 28.

Figure 7:
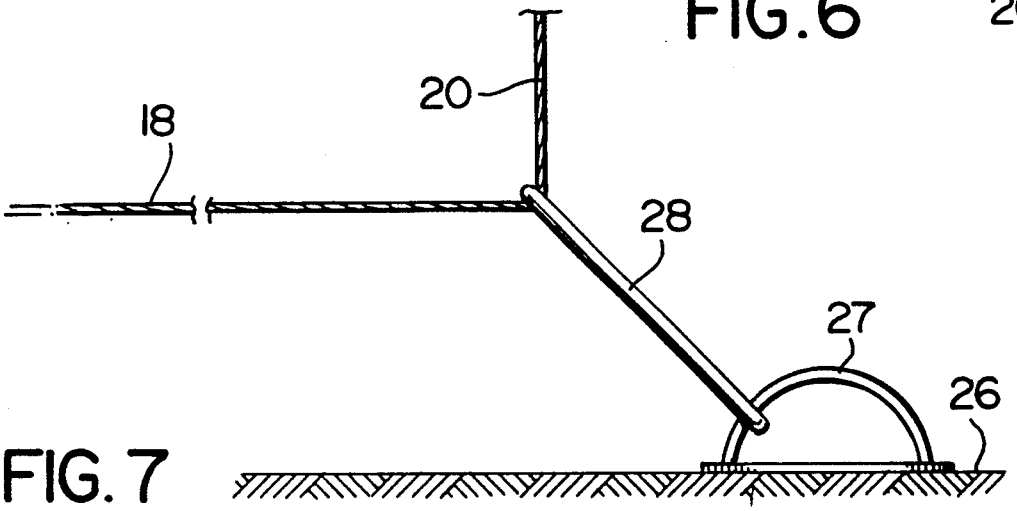
FIG. 7 is a side-elevational view of the tether mechanism of FIG. 5 in its "operative" position.

FIG. 7 shows the orientation before landing when the tagline connection is made with the tagline 20 threaded through the oval steel ring 27 and being drawn by the tugger cable 18 to the constant tension tugger winch 19 (see FIGS. 1 and 2).

Figure 8:
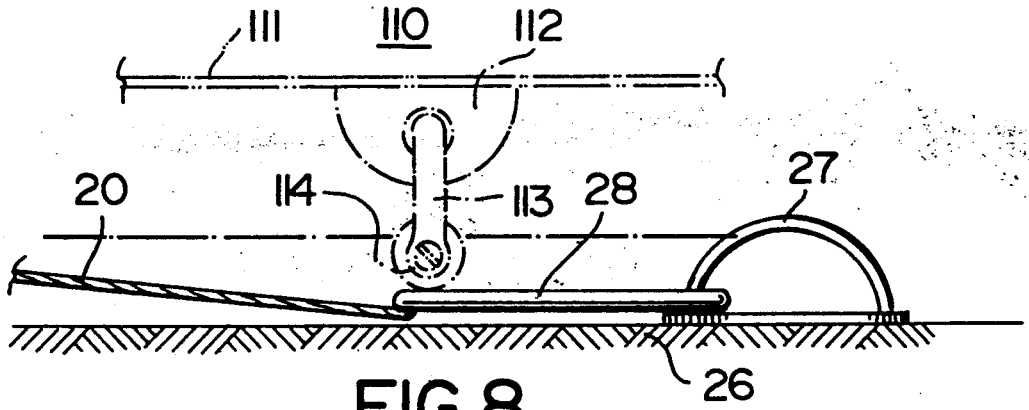
FIG. 8 is a side-elevational view of the tethered personnel transferred apparatus and the tether mechanism of FIG. 5.

As seen in FIG. 8, the personnel transfer apparatus 110 has been secured to the landing pad 17 on the steel deck 26 of the rescue vessel 16. The base 111 of the personnel transfer apparatus 110 is provided with a permanent eye 112 to which a shackle 113 is secured. The shackle 113 is returned to the tagline rope by means of a timbered eye 114.

Figure 9:
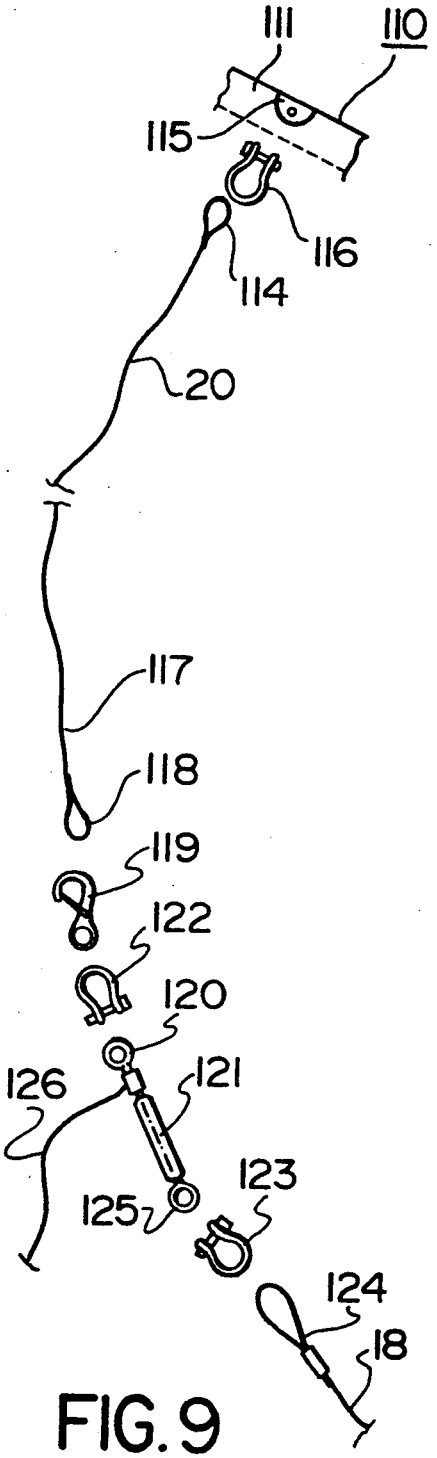
FIG. 9 is a plan view of a personnel transfer apparatus tagline shown with a load cell introduced.
Figure 10:
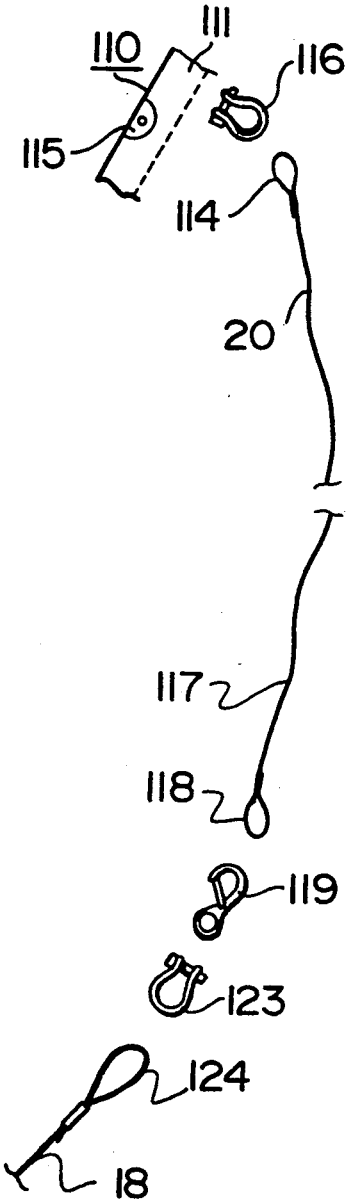
FIG. 10 is a plan view of a personnel transfer apparatus tagline which is not equipped with a load cell.
Figure 11:
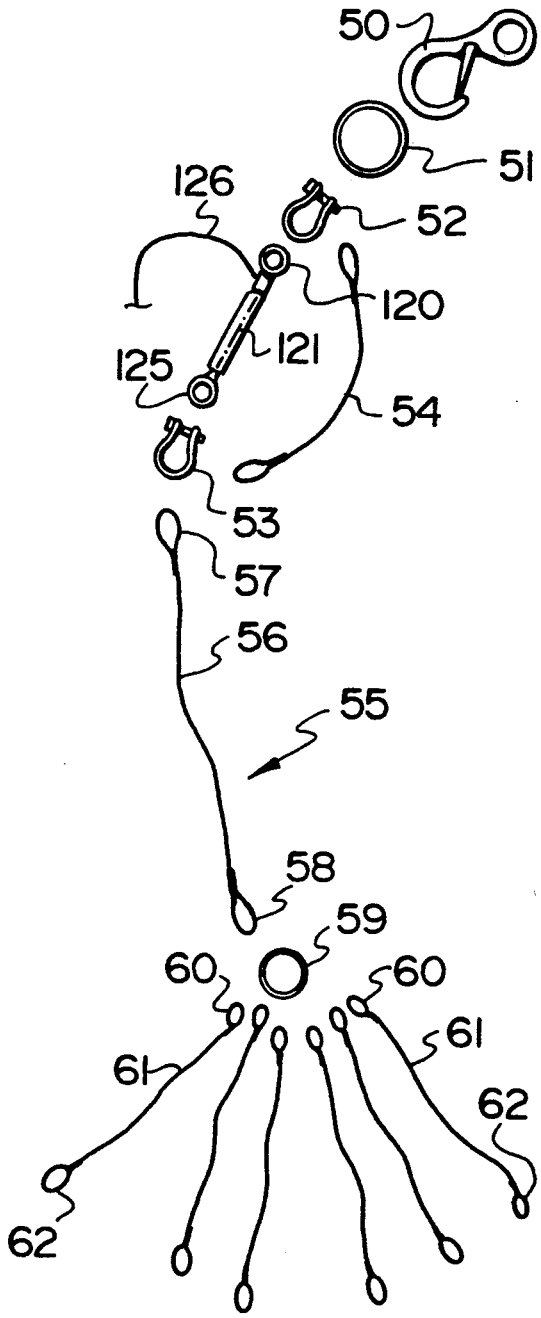
FIG. 11 is a plan view of a personnel transfer apparatus tagline with a personnel transfer apparatus lifting storing assembly.

(v) Description of FIGS. 9–11

FIGS. 9, 10 and 11 show details of the tagline arrangement. The base 111 of the personnel transfer apparatus 110 is provided with a permanent aluminum eye 115. A shackle 116 secures the timbered eye 114 of the tagline 20 (e.g., a 50 foot ⅝" wire rope) to the permanent aluminum eye 115. The other end 117 of the tagline 20 is secured by a second timbered eye 118 to a snatch hook 119. The snatch hook 119 is snapped into the top eye 120 of a load cell 121 via an upper shackle 122 and a lower shackle 123 secures the loop end 124 of the tugger cable 18 to the bottom eye 125 of the load cell (as seen in FIG. 9). Electrical connection to the load cell 121 is via load cell wire 126 (as seen in FIG. 9).

If a load cell 121 is not used, the snatch hook 119 is snapped directly into the lower timbered eye 118 of the tagline 20, the eye of the snatch hook 119 being secured by a shackle 123 to the loop end 124 of the tugger cable 18.

As seen in FIG. 11, the connection to the personnel transfer apparatus 110 is provided by a crane hook 50 forming part of the crane 13 of the drilling rig 11, which snaps onto a steel ring 51. A load cell 121 is mounted between upper shackle 52 and a lower shackle 53 by means of an upper eye 120 and lower eye 125 respectively.

For safety reasons, a safety bridle 54 is also secured across the load cell 121 between the two shackles 52, 53. The personnel transfer apparatus 110 lifting sling assembly 55 includes a main line 56 with its upper loop 57 connected to the lower shackle 53, and its lower loop 58 connected to a steel ring 59. The steel ring 59 is connected to the loop ends 60 of each of a plurality (e.g., six) personnel transfer apparatus lines 61 which are connected to the personnel transfer apparatus through their lower loops 62.

Figure 12:
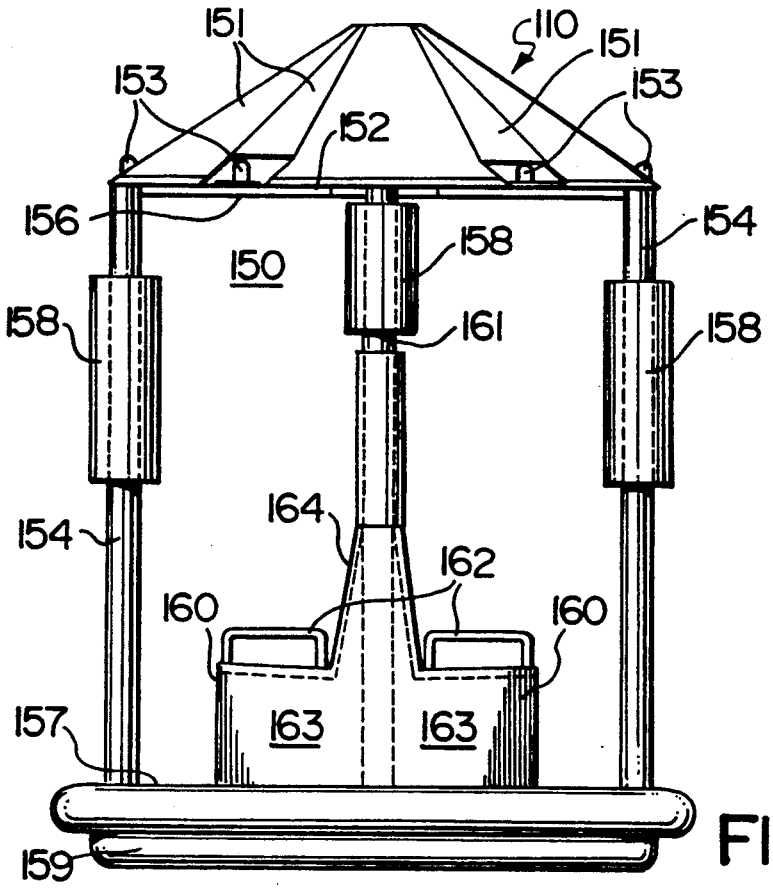
FIG. 12 is a side-elevational view of one embodiment of the personnel transfer apparatus.

(vi) Description of FIG. 12

As seen in FIG. 12, one embodiment of the personnel transfer apparatus 110 is a generally cylindrical rigid chamber 150, provided with a frusto-conically arranged plurality of struts 151 projecting upwardly from the ceiling 152 of the personnel transfer apparatus 110. The lower eared ends 153 of the struts 151 are connected to associated lines 61 of the personnel transfer apparatus lifting sling assembly 55.

The cylindrical chamber 150 is bounded by means of a plurality (e.g., six) peripheral tubular steel columns 154. The columns 154 are preferably hollow, and are filled with flotation foam and are encased in a protective material 158, e.g., cellular expansion foam or ethafoam, covered with a protective skin, e.g., vinyl. It is noted that the protective material 158 extends along a major extent of the length of column 154. The central column 161 is also preferably hollow and is also filled with flotation foam material, e.g., cellular foam. It, too, is covered with the protective material 158. The ceiling 152 is provided by a nylon mesh net 156 between the struts 151. Struts 151 extend upwardly and inwardly to provide the framework of a conical roof. The lower floor 157 of the personnel transfer apparatus 110 is provided with a flotation ring 159, e.g., made of any suitable buoyant material, e.g., a cellular expansion foam or ethafoam, covered with a protective skin, e.g., vinyl.

The embodiment shown in FIG. 12 is of the sitting type. It includes a central seating bench 160 disposed around the central column 161 which includes hand rails 162 as well as a lower luggage area 163. The framework 164 of the bench is padded with a suitable buoyant, shock-absorbing material, e.g., ethafoam covered with vinyl.

Figure 13:
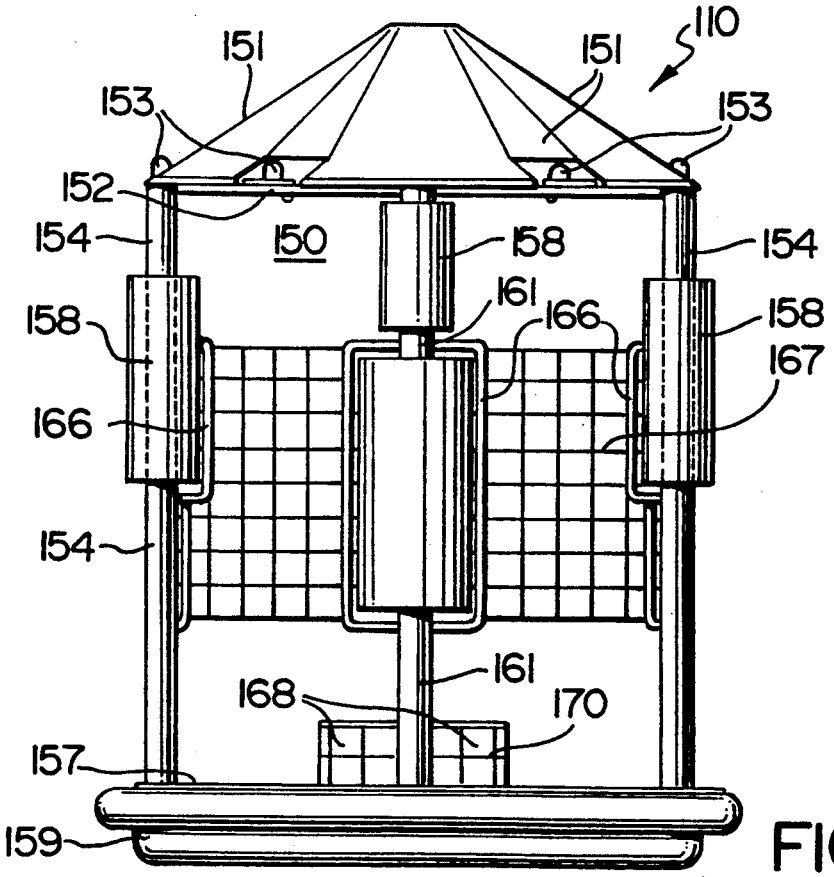
FIG. 13 is a side elevational view of another embodiment of a personnel transfer apparatus.

(vii) Description of FIG. 13

The embodiment shown in FIG. 13 is of the standing type. A plurality of vertical hand rails 166 are provided which are associated with each of the upright columns 151, 161. A guard netting of nylon mesh 167 envelopes the area of the hand rails 166. A storage unit 168 is also provided around the central column 169, bounded by nylon mesh 170.

Figure 14:
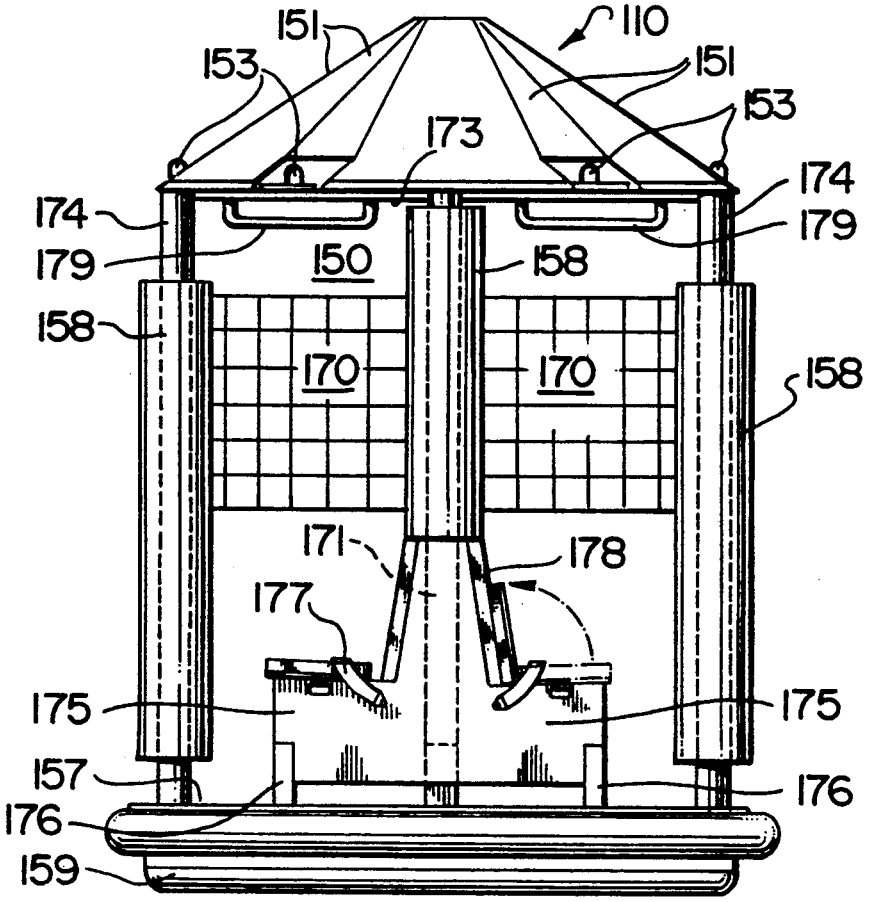
FIG. 14 is a side elevational view of yet another embodiment of the personnel transfer apparatus.
Figure 15:
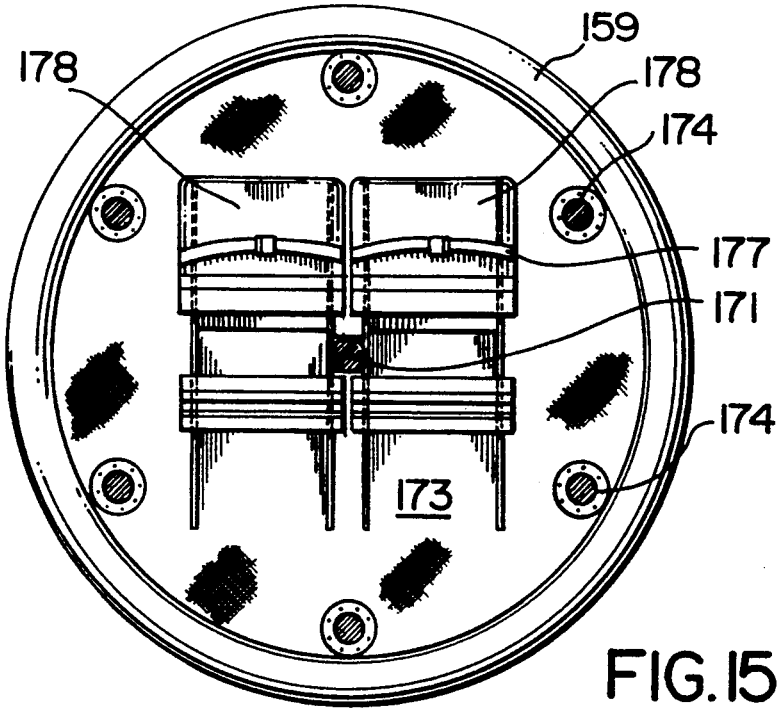
FIG. 15 is a section along the line A—A of FIG. 14.

(viii) Description of FIGS. 14 and 15

FIGS. 14 and 15 show another version of the personnel transfer apparatus 110. The central column 171 is padded as 158 from the top of a bench 178 to adjacent the ceiling 173, and the outer columns 174 are padded as 158 except for a small region near the floor 157. The standing area is enclosed by mesh 170. The luggage area 175 is provided with a shock absorbed system 176. A large safety belt 177 is also provided for each bench 178. An upper hand bar 179 is secured to the ceiling 173 of the personnel transfer apparatus 110.

The tagline 20, or personnel transfer apparatus guide wire, on one embodiment, consists of a 50-foot wire rope spliced with timbered eye on both ends. One end of the tagline is shackled to the base of the personnel transfer apparatus to allow for easy replacement of the tagline when necessary. The other end of the tagline consists of a snatch hook to enable rapid connection with the tugger winch cable, on which a load cell is installed.

The lifting sling includes six wire ropes, each rope being secured to a respective ear on the periphery of the personnel transfer apparatus. For safety reasons, each rope is capable of supporting seven times the loaded weight of the personnel transfer apparatus.

The guidance system facilitates the personnel transfer apparatus to land on the predetermined location on the supply vessel's deck when used in conjunction with the constant-tension tugger winch and the tagline. It consists of an oval-shaped steel ring (20-cm O.D. Major, 12-cm O.D. Minor), held by a rigidly deck-mounted eye. The ring is free to move in an 180° vertical plane.

The landing pad consists of ten 3'×2'×3" cellular expansion foam (CEF) pads forming an approximately 9'×10' landing pad with a 3'×4' unpadded center. The landing pad in the storage mode would require storage space of about 3'×2'×2.6". The hook-up arrangement between the rig's lifting crane and the personnel transfer apparatus is depicted in FIG. 1. A load cell is introduced at the hook-up junction to enable monitoring of any sudden loads which may be experienced by the personnel transfer apparatus during the transfer. A 2-foot ½" safety bridle/cable was shackled around the load cell as a precautionary measure.

(xv) Description of Testing Procedures

A test program was devised to do the following: field test the personnel transfer apparatus and validate the working principle of the transfer system concept;

acquire useful data, e.g., acceleration/shock forces and environmental conditions, as well as rescue vessel and rig motion, for the evaluation and further optimization of the transfer system;

conduct further testing in moderate to severe sea-states of the capability and reliability of the personnel transfer system; and establish the safe operating conditions, such as sea-states, wind and relative vessel motions, for the proposed transfer system.

The environmental conditions were a wind speed of 19 knots, and the maximum combined seas of 6' to 8'.

The test program was as follows:

Full Personnel Transfer System Transfers 10 times without tagline; with pad;

4 times with tagline; with pad;

10 times with tagline; with pad (delayed tagline release when personnel transfer apparatus returned to rig);

20 times with tagline; without pad;

11 times with tagline; without pad (delayed tagline release when personnel transfer apparatus returned to rig); and 6 times without tagline; without pad;

Lifting and Landing Tests 10 times with tagline; without pad;

5 times with tagline; with pad;

5 times without tagline; without pad;

5 times without tagline; with pad;

In addition, "swing" tests, "collision" tests and "float" tests were conducted, each repeated 4 times.

A data acquisitions system consisting of accelerometer package, inclinometers and load cells was installed on the personnel transfer system and supply vessel to enable the acquiring of useful data for subsequent evaluation of the personnel transfer system performance with respect to the environmental conditions.

In addition, three video cameras and one still camera were set up at various vantage locations to obtain a visual record of each personnel transfer system trial.

The personnel transfer system concept of using a guidance system demonstrated promising potential for safe and reliable personnel transfer. It was observed that when the personnel transfer apparatus was lowered to the rescue vessel at the crane's maximum speed, the hoisting speed of the tugger winch on the vessel was insufficient to maintain the predetermined constant tension level. At slower lowering speed, the constant tension objective was achieved.

During the first few personnel transfer system trials, it was noted that the snatch-hook on the free end of the tagline would be located at the end of the tugger wire, to prevent accidental hook-up of the tagline to other rig's or vessel's structures.

When a landing pad was provided, the transfer landing time was noted to be longer, especially when the tagline was not used for the personnel transfer apparatus landing guide. This appeared to be due to the extra effort and time needed by the crane operator to pinpoint the predetermined landing site drawn by the dimensions of the landing pad.

For proper and safe transfer of the personnel transfer apparatus, whether or not the tagline guidance system was used, the stern of the supply vessel must be within a range of proximity from the port or starboard side of the rig.

In all the personnel transfer system transfers, when constant tension on the tagline was established, the personnel transfer apparatus exhibited high wind stability potential.

Trials on delayed tagline disconnection when the personnel tagline apparatus was transferred from vessel to rig indicated that it is also possible to provide additional high-wind stability when transfer is affected from supply vessel to rig.

When the personnel transfer apparatus returned to the helideck of the rig, the sharp edge of the deck caused wear and tear to the tagline. This could have been avoided if the tagline was retrieved to the personnel transfer apparatus before vessel-to-rig transfer was affected.

During the "collision" tests, the personnel transfer apparatus was swung to the rescue vessel crash-rail. The structural integrity and rigidity of the personnel transfer apparatus was visually observed to be sufficient to absorb the impact loads.

In the "float" tests, the removable seat cushions detached from the personnel transfer apparatus. This would not have occured if the seats were occupied and the seat belts were used. The personnel transfer apparatus itself provided sufficient buoyancy and was capable of self-floating.

The concept to the personnel transfer system in using the tagline guidance for added high wind transfer stability was widely accepted as a significant improvement over the existing means of a transferring basket.

In a modified aspect of this invention a holding mesh or a net, such as those of the existing transfer basket, is incorporated into the personnel transfer apparatus. The mesh or net provides additional lateral shock absorption.

The ability of the personnel transfer apparatus to float upright is an important advantage of this invention.

Since the landing pad provides measurable contribution to shock absorption, it may be incorporated in the base of personnel transfer apparatus itself, instead of existing as a separate entity on the deck of the rescue vessel.

As a result of the above-described tests, it was found that:

1. The principle of the personnel transfer system concept was successfully and repeatedly demonstrated. The system appears to have good potential for the safe transfer of personnel in strong wind conditions.

2. The personnel transfer apparatus showed a reliable and stable behaviour in "swing" tests.

3. In order to obtain the maximum benefit of the constant tension tagline guidance system, the speed of lowering of the personnel transfer apparatus must be suitably controlled. Alternatively, the hoisting speed of the tugger may be improved.

4. The rigidity and structural integrity of the personnel transfer apparatus was demonstrated.

5. The personnel transfer apparatus was demonstrated to have self-floating capability.

6. In general, the standing option is the preferred embodiment, rather than the seating option.

The existing cargo-handling hydraulic tugger winch has a 10-ton capacity with maximum hoisting speed of 1 foot per second. In order to minimize the strain experienced by the rig's crane during a personnel transfer system transfer, it is necessary to adapt a constant-tension modification to the existing tugger winch. A constant-tension of 1.5-ton maximum capacity adaptor is installed to the tugger winch.

Sample Calculations for Constant-Tension Winch:

Staff Motor B400 = 415 in 3/revolutions
Medium Drum Diameter = 16 inches $$\text{Line Pull} = \frac{\text{in 3/revolutions} \times \text{psi}}{2}$$

$$\text{Capacity} = \frac{\text{Line Pull}}{\text{radius}}$$

$$\text{At 125 psi, capacity} = \frac{415 \times 125}{2\pi \times 8} = 1032 \text{ pounds}$$

$$\text{At 200 psi, capacity} = \frac{415 \times 200}{2\pi \times 8} = 1652 \text{ pounds}$$

$$\text{At 250 psi, capacity} = \frac{415 \times 250}{2\pi \times 8} = 2065 \text{ pounds}$$

$$\text{At 400 psi, capacity} = \frac{415 \times 400}{2\pi \times 8} = 3304 \text{ pounds}$$

3304 pounds or 1.5 tons is the maximum capacity predetermined as the maximum pull necessary for proper personnel transfer system transfer.

The module slewing crane of Bow Drill 3 (port and starboard), is the HDK 800-HM OFFSHORE model.

For the purpose of the personnel transfer system transfers, the auxiliary hoist is used. The maximum crane capacity is 5 tons for the crane boom radius of up to 40 meters.

Using this crane capacity, the speed of lowering of the personnel transfer apparatus cab be varied from 0 to 100 meters per minute or 5.5 feet per second. The following table gives detailed technical data of the rig crane of Bow Drill 3.

TECHNICAL DATE OF MODULE SLEWING CRANE
HDK 800 HM - OFFSHORE
DNV

| | |
|---|---|
| The crane has diesel-hydraulic equipment and the following basic data and specification: | |
| Main hoist: | 50 t from 8 m to 16 m radius<br>40 t up to 19 m<br>15 t up to 36 m |
| Auxiliary hoist: | 5 t from 10 m to 40 m radius |
| Radii: | |
| Main hoist: | maximum 36 m<br>minimum 8 m |
| Auxiliary hoist | maximum 40 m<br>minimum 10 m |
| Rear Length of crane: | 5.0 m measured from center of pedestal |
| Height of hook above jib pivot point: | |
| for auxiliary hoist, | |
| at maximum radius: | 5.5 m |
| at minimum radius: | 21.5 m |
| for main hoist, | |
| at maximum radius: | 5.5 m |
| at minimum radius: | 18.5 m |
| Below jib pivot point for total radius: | |
| auxiliary hoist: | 44.0 m |
| main hoist: | 47.0 m |
| Total hookpath auxiliary hoist: | 65.5 m |
| Total hookpath main hoist: | 65.5 m |
| Jib pivot point above deck: | 4.83 m |
| Auxiliary power: | 20 KW, 220 V, 60 cycles |
| Operational speeds: | (Diesel-hydrulic drives, stepless control) |
| Main Hoist: | 50 to 0 - 10 m/minute<br>40 to 0 - 12 m/minute<br>15 to 0 - 30 m/minute |
| Auxiliary Hoist: | 5 to 100 m/minute |
| Luffing hoist | |
| Luffing time: | 135 sec. from max. to min. with full load<br>45 sec. from max. to min. without load |
| Slewing Gear/Slewing Connection | |
| Slewing speed | 0–0.8 rpm 0° heel/trim<br>0–0.4 rpm 3° heel/trim |
| Diesel-hydraulic Drives for main-, auxiliary-, luffing- and slewing gears | |
| 1 diesel motor | D 2542 MTE (323 KW/1800 rpm; Rating: DNV) |
| 1 hydraulic pump for main hoist or for auxiliary hoist: | 120 KW |
| 1 hydraulic pump for luffing drive: | 159 KW |
| 1 hydraulic pump for slewing drive: | 45 KW |
| Hydraulic oil, tank capacity approx. | 1000 litres |
| Diesel fuel only, day tank capacity | 1000 litres |

CONCLUSION

From the foregoing description, one skilled in the art can easily ascertain the essential characteristics of this invention, and without departing from the spirit and scope thereof, can make various changes and modifications of the invention to adapt it to various usuages and conditions. Consequently, such changes and modifications are properly, equitably, and "intended" to be, within the full range of equivalence of the following claims.

The embodiments of the invention in which an exclusive property or privilege is claimed are defined as follows:

1. A personnel transfer apparatus for providing buoyant support for persons in water and for the transfer of persons from a first vessel to a second vessel floating on water, said apparatus comprising: a rigid, substantially-flat deck and a buoyant, shock-absorbing base supporting said deck, said deck and said shock-absorbing base having sufficient buoyancy to support the whole apparatus and said deck in the water with the deck suspended slightly below the water level; a plurality of peripheral posts and a central post upstanding from said deck, said posts being provided with protective padding along their length, said posts providing a cage for surrounding personnel on the deck, said central post not to be used for lifting purposes; a roof supported by said peripheral posts; supporting cables adapted to be associated with said roof at the area only of said peripheral posts for suspending said personnel transfer apparatus therein; and a tag line connected to said personnel transfer apparatus for connection to said second vessel.

2. The personnel transfer apparatus of claim 1 wherein said peripheral posts and said central post are each hollow, but are filled with a buoyant flotation material.

3. The personnel transfer apparatus of claim 1 including a plurality of supports connected to an associated peripheral post, said plurality of supports providing a combined frusto-conical shape, said supports thereby providing said roof thereof.

4. The personnel transfer apparatus of claim 3 wherein each said support includes a lower eared end for connection to a cable.

5. The personnel transfer apparatus of claim 1 wherein said buoyant base is formed of a suitable foam material.

6. The personnel transfer apparatus of claim 5 wherein said suitable foam material comprises ethafoam covered with vinyl.

7. The personnel transfer apparatus of claim 1 wherein said protective padding comprises a suitable buoyant foam material.

8. The personnel transfer apparatus of claim 7 wherein said suitable buoyant foam material comprises ethafoam covered with vinyl.

9. The personnel transfer apparatus of claim 1 which is also provided with personnel restraining means.

10. The personnel transfer apparatus of claim 9 wherein said personnel restraining means comprise seat belts.

11. The personnel transfer apparatus of claim 9 wherein said personnel restraining means comprises a peripheral mesh.

12. The personnel transfer apparatus of claim 1 wherein said central post is provided with a surrounding seating bench.

13. The personnel transfer apparatus of claim 12 wherein said bench is provided with a lower storage area.

14. The personnel transfer apparatus of claim 12 wherein said surrounding seating bench is provided with scat belts.

15. The personnel transfer apparatus of claim 14 wherein the base of said bench is provided with a shock absorbing system.

16. The personnel transfer apparatus of claim 14 wherein said roof is provided with hand rails.

17. The personnel transfer apparatus of claim 1 wherein said central post is provided with a cylindrical surrounding vertically arranged hand rail.

18. The personnel transfer apparatus of claim 17 wherein the area at the base of said central post is provided with a storage area.

19. The personnel transfer apparatus of claim 17 wherein said hand rails are also provided with an encircling mesh material.

20. The personnel transfer apparatus of claim 1 wherein said peripheral posts are provided with vertical hand rails.

21. The personnel transfer apparatus of claim 1 wherein said roof is provided with a mesh ceiling.

22. A personnel transfer system including a swingable boom system for transferring personnel from one vessel to another vessel comprising:

a) a swingable boom system associated with one vessel;

b) means at the end of said swingable boom system for temporarily but firmly securing said boom to a personnel transfer apparatus;

c) a tagline and tagline guidance means connected between said personnel transfer apparatus and a landing area on said second vessel;

d) a tugger line having a loop end, said tugger line being connected to said tagline; and e) a constant tension winch associated with said second vessel and connected to said loop end of said tugger line for winding in and paying out said tugger line.

23. The personnel transfer system of claim 22 wherein said personnel transfer apparatus is provided with a depending ear for securement to said tagline.

24. The personnel transfer system of claim 23 wherein said tagline includes a lowered timbered eye, an upper timbered eye, a first shackle secured to said upper timbered eye said shackle also being secured to said depending ear on the base of said personnel transfer apparatus; and including a snatch hook connected to said lower timbered eye, and a second shackle connecting said tagline to said loop end of said tugger line.

25. The personnel transfer system of claim 24 including a load cell interposed between said first shackle connected to said tagline, and said second shackle connected to said loop end of said tugger line.

26. The personnel transfer system of claim 25 including a safety bridle spanning said load cell.

27. The personnel transfer system of claim 24 including a lifting sling assembly, said lifting sling assembly comprising: a plurality of lifting sling lines, each said lifting sling line having a loop end, the loop ends of each of said lifting sling line being secured to a ring which is secured to a lower loop end of said tugger line, each said lifting sling line being adapted to be secured to a depending ear of said personnel transfer apparatus.

28. The personnel transfer system of claim 22 wherein said landing area comprises a plurality of individual pads of shock-absorbing material surrounding a tether area, each adjacent said individual pad being secured to one another by rope means.

29. The personnel transfer system of claim 22 wherein said tether area contains a tether comprising:

f) a base plate secured to the deck of said vessel;

g) a semi-circular ring secured to said base plate; and h) a ring captured by said semi-circular ring.

30. The personnel transfer system of claim 22 wherein said personnel transfer apparatus comprises:

a rigid, substantially-flat deck and a buoyant, shock-absorbing base supporting said deck, said deck and said shock-absorbing base having sufficient buoyancy to support the whole apparatus and said deck in the water with the deck suspended slightly below the water level; a plurality of peripheral posts and a central post upstanding from said deck, said posts being provided with protective padding along their length, said posts providing a cage for surrounding personnel on the deck, said central post not to be used for lifting purposes; a roof supported by said peripheral posts; supporting cables adapted to be associated with said roof at the area only of said peripheral posts for suspending said personnel transfer apparatus therein; and a tag line connected to said personnel transfer apparatus for connection to said second vessel.

* * * * *